US005207216A

United States Patent [19]

Sweeny

[11] Patent Number: 5,207,216

[45] Date of Patent: May 4, 1993

[54] PHYSICAL THERAPY MACHINE

[76] Inventor: David R. Sweeny, 4950 Woodruff Springs Rd., Sanford, Fla. 32771

[21] Appl. No.: 957,360

[22] Filed: Oct. 5, 1992

[51] Int. Cl.[5] ..... A61H 1/02

[52] U.S. Cl. ..... 128/25 R

[58] Field of Search ..... 128/25 R, 25 B, 25 C, 128/26, 75; 606/241-245; 482/55, 57, 7, 120

[56] References Cited

U.S. PATENT DOCUMENTS

| | | | |
|---|---|---|---|
| 3,060,926 | 10/1962 | May | 128/25 R |
| 3,712,613 | 1/1973 | Feather et al. . | |
| 4,353,547 | 10/1982 | Jenkinson . | |
| 4,407,495 | 10/1983 | Wilson . | |
| 4,828,255 | 5/1989 | Lahman . | |
| 4,986,261 | 1/1991 | Iams et al. | 128/25 R |
| 5,058,888 | 10/1991 | Walker et al. . | |
| 5,099,828 | 3/1992 | Duke | 128/25 R |

*Primary Examiner*—Richard J. Apley
*Assistant Examiner*—Jeanne M. Mollo
*Attorney, Agent, or Firm*—Edward M. Livingston

[57] ABSTRACT

A physical-therapy machine has a horizontal body platform (2) on a machine frame (1) with motorized leg, arm and head support members (4–7, 28, 31, 33, 34 and 47) that are moveable separately and selectively to activate body joints associated with major muscle groups for disabled individuals. Cables (15, 19, 41, 44 and 52) connected to reels (17, 18, 43, 46 and 54) are positioned in contact with pulley wheels (26 and 27) on eccentric cranks (21 and 22) which are rotated to transmit oscillational travel of total limb-support members and of sections of the limb-support members circumferentially through a lever (11, 13, 35, 36 and 50) for each limb. Angular degree of circumferential travel of separate body-limb supports is adjustable by variation of length of the cable reciprocated by the eccentric cranks. Angular oscillational travel of sections of the separate body-limb supports is adjustable by circumferential hinge restraints (70). For individuals whose disabilities are not permanent, muscle-resistant exercise is provided progressively and simultaneously with joint activation by resistance to oscillational travel of the limb-support members and the sections thereof.

28 Claims, 4 Drawing Sheets

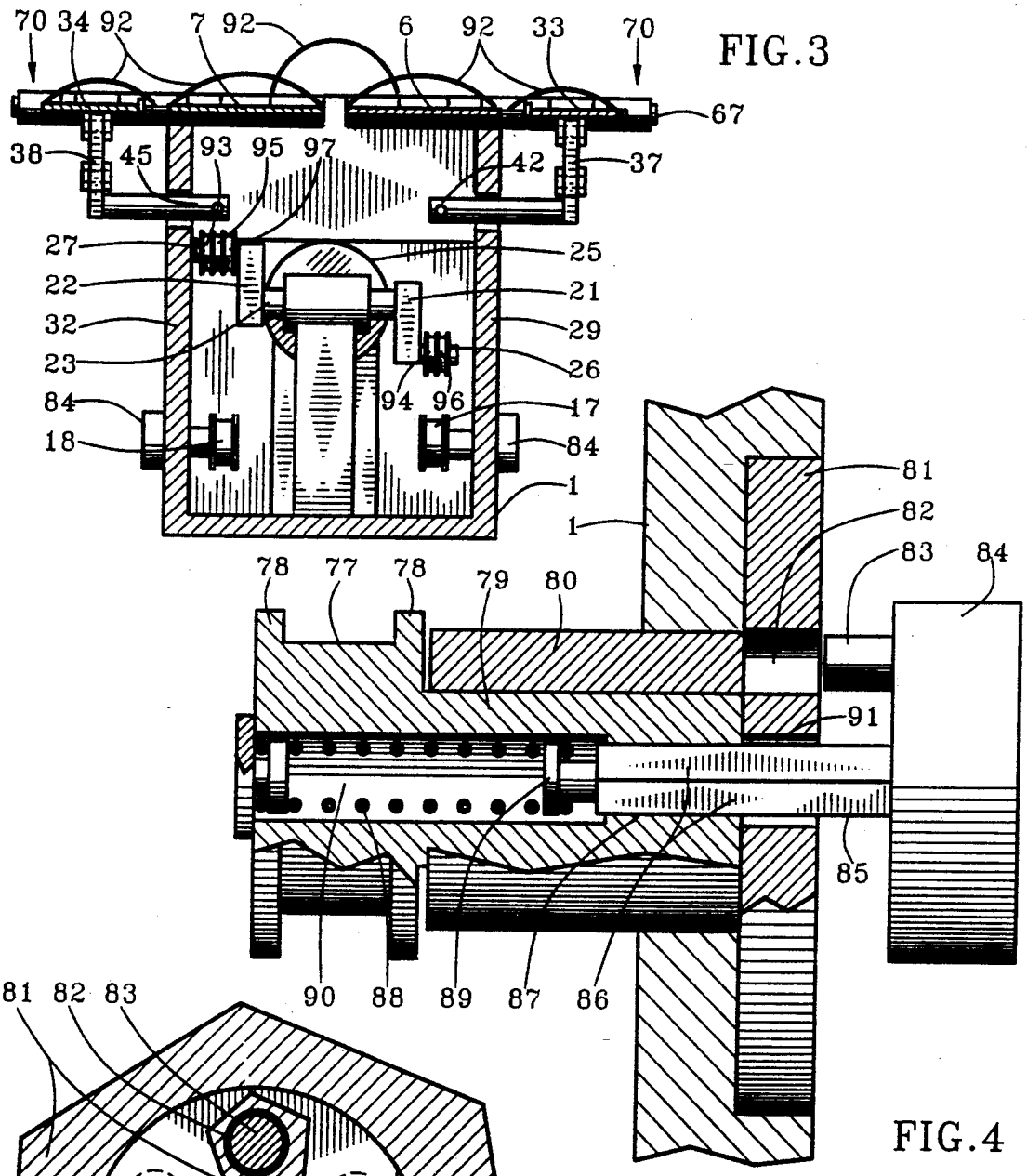
FIG.3
FIG.4
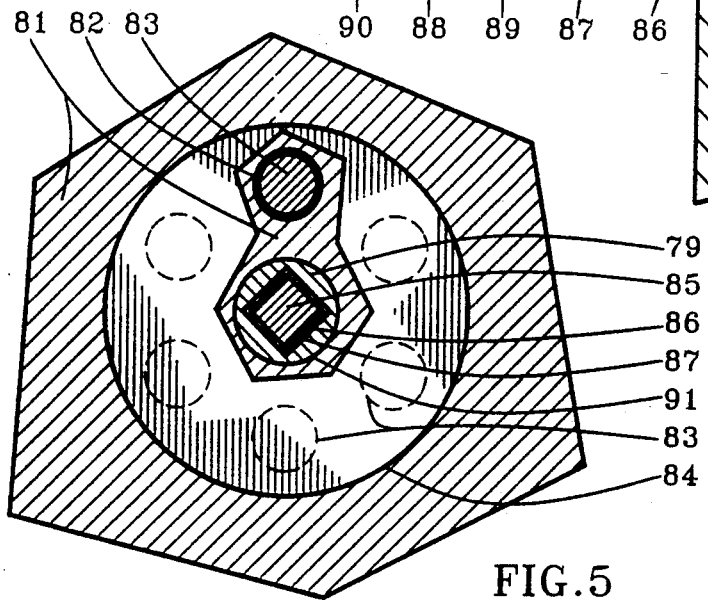
FIG.5

FIG.6
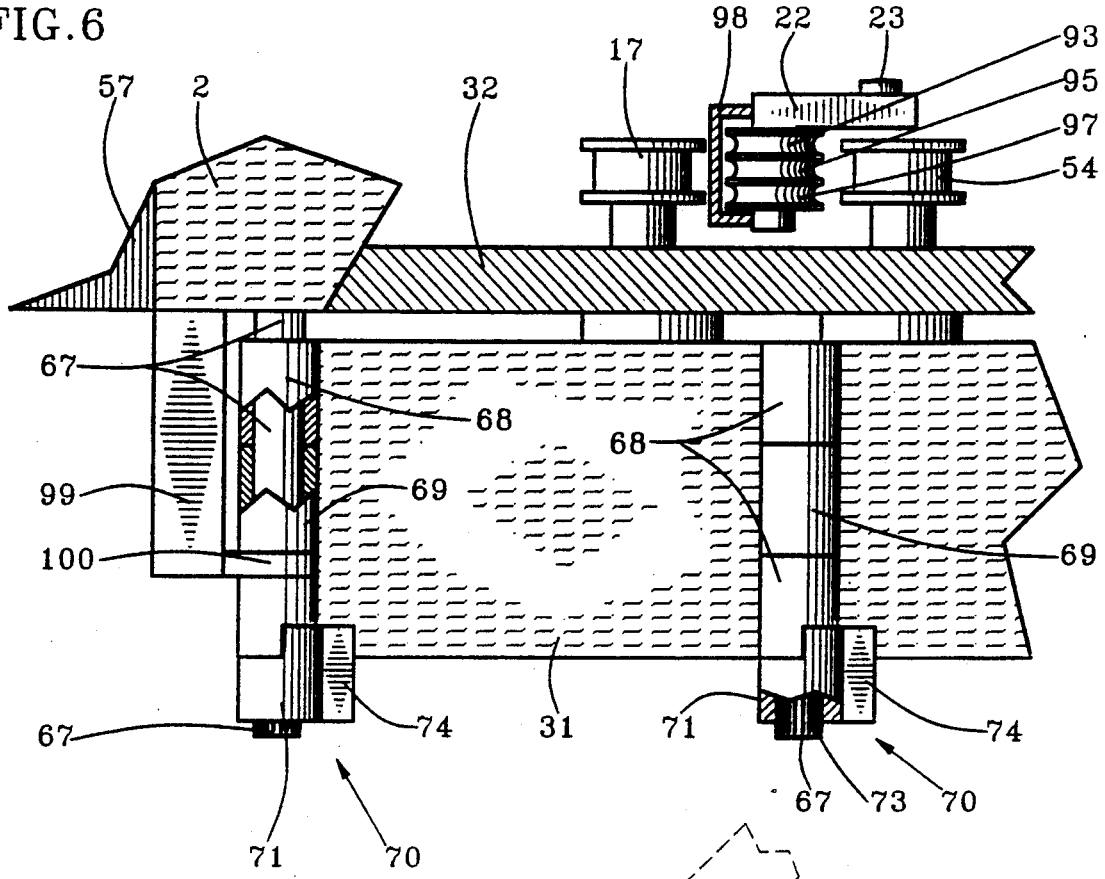
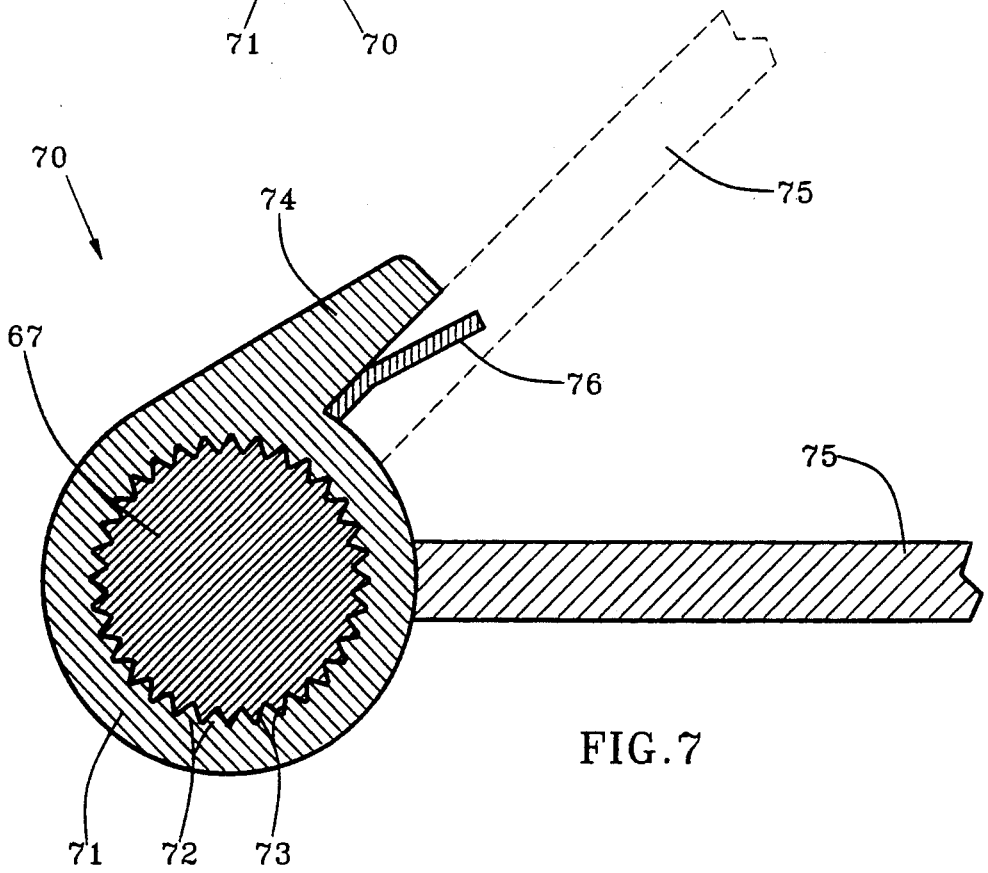
FIG.7

PHYSICAL THERAPY MACHINE

BACKGROUND OF THE INVENTION

This invention relates to physical-therapy machines and in particular to a machine which exercises joints of disabled people such as paraplegics, arthritic patients and individuals with long-lasting injury which effects leg, arm, neck and back portions of the body.

Currently, disabled people such as paraplegics and arthritic patients need the help of physical therapists and others under direction of medical doctors to manipulate and to work the joints of their bodies manually. There is no single machine available to do this manual work effectively. There are numerous exercise machines for resisting action of muscles and related joints in order to increase physical strength. But there are none that function oppositely to aid, rather than to resist, action of joints and related muscles in order to overcome dysfunction of joints. This is particularly significant for paraplegics who are paralyzed permanently from the waist down and suffer immensely from lack of body movement. People who have been injured in ways that temporarily prevent them from moving their limbs and major muscles often contract arthritis from lack of movement. In particular, previously active and muscular people are more likely than less active and less muscular people to be affected with arthritis when their muscles and the joints associated with them are inactive for a significant period of time. Deposits of organic minerals often build up in granular form. Painful swelling results. Gout occurs similarly.

This invention can activate all joints associated with major muscle groups. And it can do it more effectively over any length of time than a team of physical therapists. It alleviates harmful effects from inaction of all major body joints. Then, if and to the extent that cure can be achieved at otherwise inactive joints, this invention can be used to strengthen muscles and joints together more effectively than existing exercise machines. For those who can be cured, simultaneous assistance and resistance to body activity can be provided during a period of transition from dysfunction to a healthy condition of major muscle groups and related joints.

Examples of different prior art can be found in numerous exercise-machine patents. No matter what their structure, all prior-art devices are designed to resist rather than to aid action of muscles and related body joints. The need for assistance in movement of joints has not been addressed in the prior art. Instead, the needs for joint exercise separately from muscle exercise have been supplied previously by physical therapists. They manipulate body joints manually. Cost for such physical therapy is high and most often inadequate. Previously, preoccupation with machines for muscle-resisting exercise has overshadowed and obscured need for machines to aid movement of joints for variously-disabled individuals. A large number of prior-art patents and a wide variety of known body-building machines have been reviewed for similarities to this invention. None have been found to be sufficiently comparable to reference as related devices. A large number of prior-art devices provide body platforms such as described in U.S. Pat. Nos. 5,058,888, 4,828,255, 4,407,495 and 4,353,547, but only for purposes of supporting an individual in a prone position for muscle-resistant exercise. Their platforms are not functional parts of joint-activation machines as taught by this invention. Some of the prior-art platforms have contour adjustment as described in U.S. Pat. No. 3,712,613, but only as means to reposition the body for different muscle-resistant exercises. None of the prior art provides mechanization for activation and movement of body joints as taught by this invention. Further yet, none have provided joint-exercise movement which is transitional into muscle exercise for patients who are not permanently disabled.

SUMMARY OF THE INVENTION

A primary object of this invention is to provide mechanized manipulation of body joints associated with major muscle groups for disabled individuals to compensate for muscle and nerve incapacitation.

Another object is to provide fully-variable manipulation of different body joints for various joint-activation needs.

A further object is to provide effective and controllably-continuous joint activation at low cost for disabled individuals.

A even further object is to provide effective joint activation that is available to disabled individuals without human-factor problems associated with obtaining assistance of others for body functions.

Yet another object is to provide joint-exercise activity that is transitional into muscle exercise progressively and simultaneously for individuals whose disabilities are not permanent.

This invention accomplishes the above and other objectives with a physical-therapy machine having a horizontal body platform on a machine frame with motorized leg, arm and head support members that are moveable separately and selectively to activate body joints associated with major muscle groups for disabled individuals. Cables connected to reels are positioned in contact with pulley wheels on eccentric cranks which are rotated to transmit oscillational travel of total limb-support members and of sections of the limb-support members circumferentially through a lever for each limb. Angular degree of circumferential travel of separate body-limb supports is adjustable by variation of length of cable reciprocated by separate eccentric cranks. Angular oscillational travel of sections of the separate body-limb supports is adjustable by circumferential hinge restraints. For individuals whose disabilities are not permanent, muscle-resistant exercise is provided progressively and simultaneously with joint activation by resistance to oscillational travel of the limb-support members and the sections thereof.

BRIEF DESCRIPTION OF THE DRAWINGS

This invention is described by appended claims in relation to description of a preferred embodiment with reference to the following drawings wherein:

FIG. 3 is a sectional front view;

FIG. 4 is a cutaway sectional side view of a reel anchor;

FIG. 5 is a cutaway sectional side view of the reel anchor;

FIG. 6 is a cutaway sectional top view showing a rotation restraint for an elbow and an arm joint; and FIG. 7 is a sectional end view of the rotation restraint.

DESCRIPTION OF PREFERRED EMBODIMENTS

Figure 1:
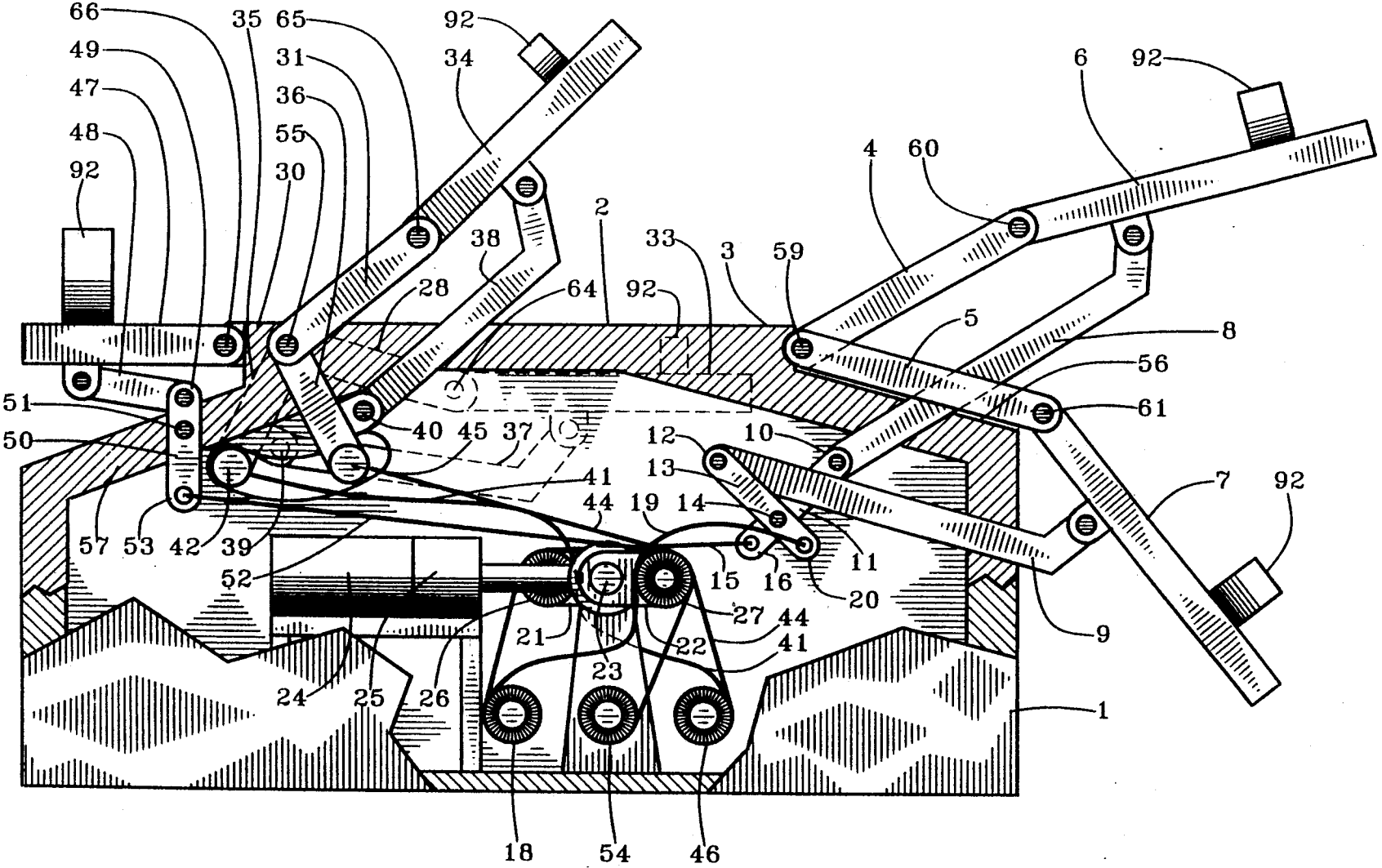
FIG. 1 is a cutaway side view.
Figure 2:
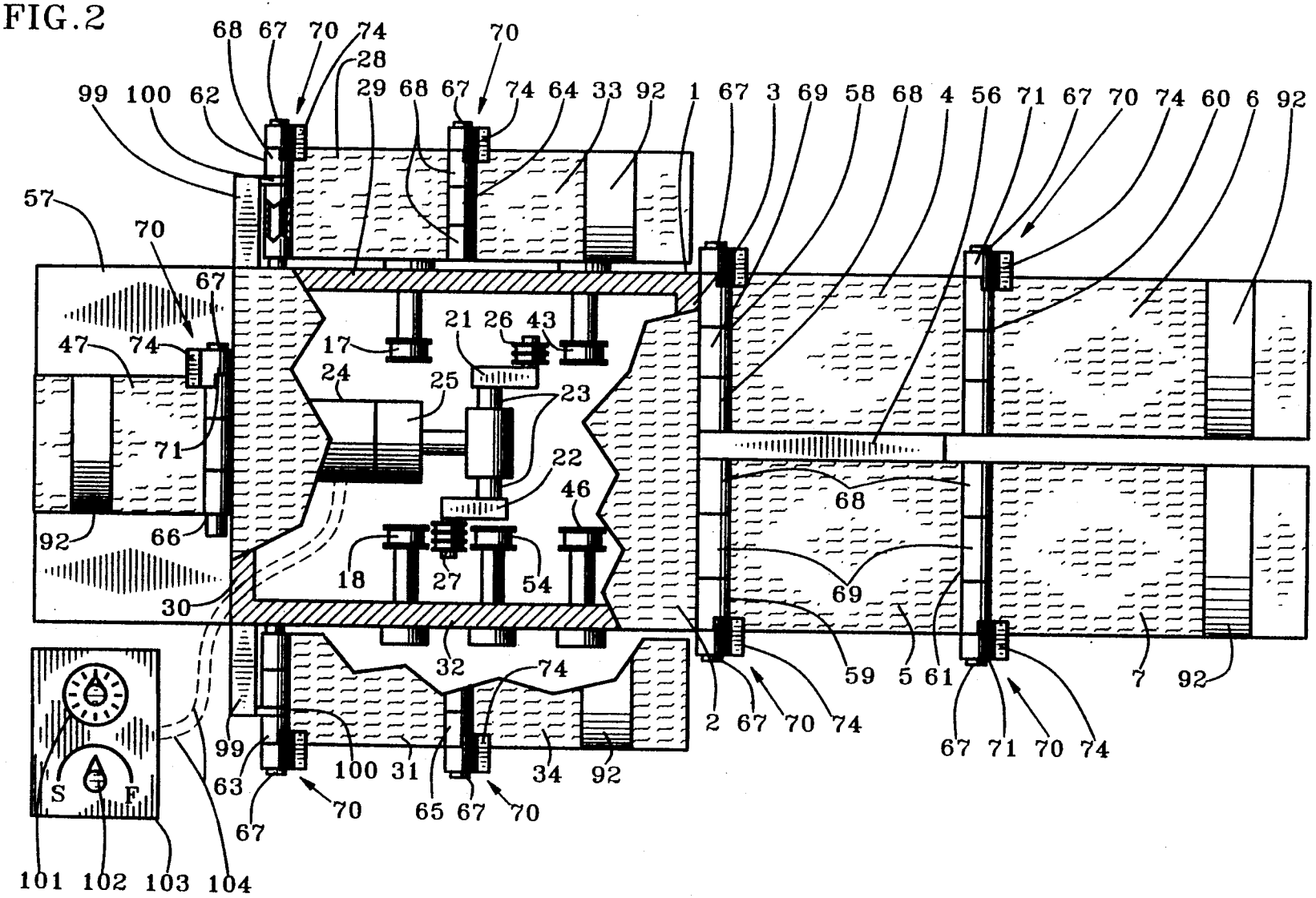
FIG. 2 is a cutaway top view.

Reference is made primarily to FIG. 1 and secondarily to FIG. 2. A machine frame 1 has a body platform 2 on top of it. At a foot end 3 of the machine frame 1, an upper-left-leg support member 4 and an upper-right-leg support member 5 are attachable pivotally to the machine frame 1 in side-by-side relationship. Attachable pivotally to the upper-left-leg support member 4 is lower-left-leg support member 6. Attachable pivotally to the upper-right-leg support member 5 is lower-right-leg support member 7. The left-leg support members 4 and 6 and the right-leg support member 5 and 7 are oscillated up-and-down to activate joints of patients in an assimilated walking motion.

A walking motion is achieved by cable-actuated lever action of a left-leg connecting rod 8 that is attached pivotally to a bottom side of the lower-left-leg support member 6 and a right-leg connecting rod 9 that is attached pivotally to a bottom side of the lower-right-leg support member 7. The left-leg connecting rod 8 is attached pivotally to a rod end 10 of left-leg lever 11. The right-leg connecting rod 9 is attached pivotally to a rod end 12 of right-leg lever 13. Levers 11 and 13 are pivotal on axles attached to the machine frame 1 that can have a common axis at a fulcrum position 14. Left-leg cable 15 is attached to cable end 16 of left-leg lever 11 and to left-leg cable reel 17 shown in FIG. 2. Left-leg cable reel 17 is indicated synonymously also in FIG. 1 by concentricity with right-leg cable reel 18. Right-leg cable 19 is attached to cable end 20 of right-leg lever 13 and to right-leg cable reel 18. Between the cable reels 17 and 18 and the cable ends 16 and 20 of levers 11 and 13, left-side cable crank 21 and right-side cable crank 22 are rotated on crank axle 23 by motor 24 through gear means 25. Rotation of cable cranks 21 and 22 positions a left-side pulley 26 and a right-side pulley 27 alternately in contact with cables 15 and 19 during portions of rotation on axle 23. A circumferential portion of rotation of the pulleys 26 and 27 during which cables 15 and 19 are in contact with pulleys 26 and 27 and thereby transmit oscillational motion to the cable ends 16 and 20 of levers 11 and 13 is determined by an amount of cable reeled onto reels 17 and 18. Winding cables 15 and 19 onto reels 17 and 18 causes the pulleys 26 and 27 to be in contact with cables 15 and 19 and thereby to transmit oscillational travel during a relatively large circumferential portion of rotation. This causes relatively greater oscillational travel of the levers 11 and 13 and consequently greater travel of leg-support members 4–7. Conversely, unwinding the reels 17 and 18 leaves the cables 15 and 19 loose and either not in contact with the pulleys 26 and 27 or in contact with them during smaller portions of circumferential travel to transmit less oscillational travel to the levers 11 and 13 and, therefore, less travel to leg-support members 4–7 through connecting rods 8 and 9.

The amount of oscillational travel is controllable independently for the separate leg-support members 4–7. Independent control is achieved by independent winding of cables 15 and 19 on reels 17 and 18.

An upper-left-arm support member 28 is attached pivotally to a left side 29 of a head end 30 of the machine frame 1. An upper-right-arm support member 31 is attached pivotally to a right side 32 of the head end 30 of the machine frame 1. A lower-left-arm support member 33 is attached pivotally to the upper-left-arm support member 28 and a lower-right-arm support member 34 is attached pivotally to the upper-right-arm support member 31. A left-arm lever 35 is attached pivotally to the left side 29 of the head end 30 of the machine frame 1 at a position proximate or concentric with pivotal attachment of the upper-left-arm support member 28 to the machine frame 1. A right-arm lever 36 is attached pivotally to the right side 32 of the head end 30 of the machine frame 1 at a position proximate or concentric with pivotal attachment of the upper-right-arm support member 31 to the machine frame 1. A left-arm connecting rod 37 is attached pivotally to a bottom side of the lower-left-arm support member 33. A right-arm connecting rod 38 is attached pivotally to a bottom side of the lower-right-arm support member 34. The left-arm connecting rod 37 is attached pivotally to the left-arm lever 35 at a left-arm-lever load point 39 and the right-arm connecting rod 38 is attached pivotally to the right-arm lever 36 at a right-arm-lever load point 40.

An arm-swinging motion of left-arm support members 28 and 33 is achieved by oscillating action of left-arm cable 41 that is connected to a cable end 42 of left-arm lever 35 and to left-arm reel 43. An oppositely arm-swinging motion of the right-arm support members 31 and 34 is achieved by oscillating action of right-arm cable 44 that is connected to a cable end 45 of right-arm lever 36 and to right-arm reel 46.

Like the oscillation of the leg cables 15 and 19, oscillational-travel distance of arm cables 41 and 44 is controlled by the amounts of cables 41 and 44 that are reeled onto reels 43 and 46 and caused thereby to come in contact with pulley wheels 26 and 27. Unlike oscillation for leg-support members 4–7, however, the arm levers 35 and 36 are Class II levers instead of Class I levers 11 and 13.

A head support member 47 is attached pivotally to the head end 30 of the machine frame 1. A head connecting rod 48 is attached pivotally to a bottom side of the head support member 47 and to a rod end 49 of a head lever 50. The head lever 50 is a Class I type of lever with a fulcrum point 51 of the head lever 50 attached pivotally to the machine frame 1. A head cable 52 is attached to a cable end 53 of the head lever 50 and to head reel 54. The head support member 47 is swiveled up-and-down by action of pulley 27 against the head cable 52. Control of oscillational distance of travel of the head support member is achieved by the amount of head cable 52 that is reeled onto head reel 54.

The crank axle 23 is positioned selectively below levers 11, 13, 35, 36 and 50 sufficiently to position rotational contact of pulleys 26 and 27 with cables 15, 19, 41, 44 and 52 below leg-lever attachment axis 14, below arm-lever attachment axis 55 and below head-lever attachment axis 51. The crank axle 23 is positioned also between the foot end 3 of the machine frame 1 and the head end 30 of the machine frame 1. The reels 17, 18, 43, 46 and 54 are positioned vertically below the crank axle 23. A leg-rest section 56 and a head-rest section 57 of the machine frame 1 have a double function of positioning leg and head levers below support members and of providing a travel restraint at extremities of downward travel of the leg and head support members.

Reference is made primarily to FIG. 2 and secondarily now to FIG. 1. The upper-left-leg support member 4 is attached to the machine frame 1 at a left-leg joint 58. Likewise, the upper-right-leg support member 4 is attached to the machine frame 1 at a right-leg joint 59. The lower-left-leg support member 6 is attached to the upper-left-leg support member 4 at left-knee joint 60 and the lower-right-leg support member 7 is attached to the upper-right-leg support member 5 at right-knee joint 61. The upper-left-arm support member 28 is attached to the machine frame at a left-arm joint 62 and the upper-right-arm support member 31 is attached to the machine frame 1 at a right-arm joint 63. The lower-left-arm support member 33 is attached to the upper-left-arm support member 28 at a left-elbow joint 64 and the lower-right-arm support member 34 is attached to the upper-right-arm support member 31 at a right-elbow joint 65. The head-support member 47 is attached to the machine frame at a head joint 66.

Reference is made now to FIGS. 1, 2, 6 and 7. The joints 58–66 can be any type of a wide variety of pivotal connections. A preferred type of pivotal connection is similar to a conventional door hinge but with a hinge-pin axle 67 rigidly fixable to one or more proximal hinge sleeves 68. The proximal hinge sleeves 68 are those attached to or extended from a proximal unit such as the machine frame 1 for pivotal attachment of upper members 4, 5, 28 or 31. The proximal hinge sleeves 68 are also those attached to or extended from the upper support members 4, 5, 28 or 31 for pivotal attachment of lower members 6, 7, 33 or 34. Distal hinge sleeves 69 are pivotal on the hinge-pin axle 67. This type of hinge makes possible the use of a rotation restraint 70 for adjusting oscillational travel of distal support members 6, 7, 33 and 34 in proportion to proximal support members 4, 5, 28 and 31.

Rotation restraint 70 has a restraint sleeve 71 with internal splines 72 that are internally-projecting serrations. The internal splines 72 fit between external splines 73 that are externally-projecting serrations extended outward radially from the hinge-pin axle 67. The serrations 72 and 73 can be variously pointed with rounded tips as shown or more square-cornered as used conventionally for automotive-axle splines. For the use-conditions related to this machine, the form illustrated is preferable and less expensive to produce. Shafts with such splines of either form are readily available on the market and splined sleeves are readily producible. Protruding radially from the restraint sleeve 71 and extending linearly to a position circumferentially external to proximal hinge sleeves 68 is a restraint wall 74. Due to a non-pivotal, rigid attachment of the sleeve 71 to the axle 67, either support member 4–7, 28, 31, 33, 34 or 47, represented generally in FIG. 7 as 75, will be restrained from rotation at a circumferential position determined by circumferential positioning of the restraint sleeve 71 of the variable-rotation restraint 70 on the axle 67. A form of spring cushion 76 can be attached to restraint walls 74 as shown in FIG. 7 to avoid abruptness of contact of support members 75 with the restraint wall 74. This variable-rotation restraint 70 is easily removable and positional as desired on axle 67 at either joint 58–66.

Reference is made now to FIGS. 1–6 regarding reels 17, 18, 43, 46 and 54. As for the rotation restraints 70, each reel can have substantially the same construction although controllable separately. There are a wide variety of known reel controls. A preferred reel structure and form for this invention is illustrated in FIGS. 4 and 5. A reel wheel 77 with reel shoulders 78 has a reel axle 79 in rotational contact with reel-bearing sleeve 80 that is attached to a regulator flange 81. The regulator flange 81 comprised of reel-anchor material is attached to a wall or other desired part of machine frame 1 at either side as appropriate for containing either reel 17, 18, 43, 46 or 54. Reel-anchor orifices 82 in reel-anchor flange 81 are provided to receive anchor pin 83 which is extended from rotation knob or handle 84. The rotation handle 84 is attached to a reel-rotation rod 85 which has one-or-more rod-spline surfaces 86 which engage matching axle-spline internal surfaces 87 which comprise a splined orifice in reel axle 79. The reel-rotation rod 85 is pulled into the splined orifice formed by internal surfaces 87 by an anchor spring 88 to cause engagement of anchor pin 83 with a desired reel-anchor orifice 82 unless the rotation handle 84 is pulled out manually for desired rotation and circumferential positioning. The anchor spring 88 can be suspended in contracting-spring-pressure relationship between a distal end 89 of the reel-rotation rod 85 and a surface of the reel wheel 77 in a spring orifice 90. The regulator flange 81 can have a shaft orifice 91 with a sufficient diameter to allow rotation of the reel-rotation rod 85 without obstruction of rotation by the regulator flange 81.

Referring next to FIGS. 1–3, tie-down straps 92 can be provided for positioning a patient safely on this physical-therapy machine. They can be used also for resisting movement of either one or any combination of the support members 75 to provide muscle exercise for curable patients. A wide variety of straps 92 can be employed for various patient conditions. Only a schematic form of straps 92 is illustrated to include variations thereof.

Referring to FIGS. 1, 2 and 6, the body platform 2 and the support members 4–7, 28, 31, 33, 34 and 47 can be covered with various form-fitting cushion material as desired. The top surfaces illustrated are hatched with flex indicia to indicate this cushion factor.

Referring to FIGS. 1, 2, 3 and 6, pulley wheels 26 and 27 are provided with a left-leg pulley section 93, a right-leg pulley section 94, a left-arm pulley section 95, a right-arm pulley section 96 and a head pulley section 97 respectively. These sections can be separately rotational or rotational together. For some applications it is preferable also to have a cable keeper 98, as illustrated in FIG. 6 or in some other form, to keep the pulleys 15, 19, 41, 44 and 52 in position when not being activated by pulleys 26 and 27.

Referring to FIGS. 2 and 6, arm braces 99 can be provided with support bearings 100 to provide structural integrity for arm joints 62 and 63. This allows use of relatively smaller axles 67. The arm braces 99 can be used also for restraints of rotation of upper-arm-support members 31 and 33 as an alternative to restraints 70.

Referring to FIG. 2, a timer 101 and a speed regulator 102 can be provided on a control panel 103 for controlling operation of this physical-therapy machine. The control panel 103 can be positional as desired and provided with control lines 104 in control relationship with motor 24 and gears 25.

A new and useful physical-therapy machine having been described, all such modifications, adaptations, substitutions of equivalents, combinations of components, applications and forms thereof as described by the following claims are included in this invention.

I claim:

1. A physical-therapy machine comprising:

a body platform on a top of a machine frame;

an upper-left-leg support member pivotally attachable to a foot end of the machine frame at a left-leg joint;

a lower-left-leg support member pivotally attachable to the upper-left-leg support member at a left-knee joint;

an upper-right-leg support member pivotally attachable to a foot end of the machine frame at a right-leg joint;

a lower-right-leg support member pivotally attachable to the upper-right-leg support member at a right-knee joint;

a left-leg connecting rod pivotally attachable to a bottom side of the lower-left-leg support member and extended into a foot end of the machine frame;

a left-leg lever to which the left-leg connecting rod is pivotally attached at a rod end of the left-leg lever;

a left-leg cable having a lever end of the left-leg cable attached to a cable end of the left-leg lever;

a left-leg-lever axle to which the left-leg lever is attached pivotally at a fulcrum position between the rod end of the left-leg lever and the cable end of the left-leg lever;

the left-leg-lever axle being attached to the machine frame and extended perpendicularly to the upper-left-leg support member and the lower-left-leg support member within the machine frame;

a left-leg-cable reel attached pivotally to a left-leg-reel axle attached to the machine frame and extended parallel to the left-leg-lever axle;

a reel end of the left-leg cable attached to the left-leg cable reel;

a left-side cable crank having a left-side crank axle parallel to the left-leg-reel axle and attached pivotally to the machine frame;

a left-leg-crank pulley wheel attached pivotally to a crank end of the left-side cable crank;

the left-leg cable being in selective contact with the left-leg-crank pulley wheel during portions of rotation of the left-side cable crank as determined by a portion of the left-leg cable reeled onto the left-leg-cable reel;

a right-leg connecting rod pivotally attachable to a bottom side of the lower-right-leg support member and extended into the foot end of the machine frame;

a right-leg lever to which the right-leg connecting rod is pivotally attached at a rod end of the right-leg lever;

a right-leg cable having a lever end of the right-leg cable attached to a cable end of the right-leg lever;

a right-leg-lever axle to which the right-leg lever is attached pivotally at a fulcrum position between the rod end of the right-leg lever and the cable end of the right-leg lever;

the right-leg-lever axle being attached to the machine frame and extended perpendicularly to the upper-right-leg support member and the lower-right-leg support member within the machine frame;

a right-leg cable reel attached pivotally to a right-leg-reel axle attached to the machine frame and extended parallel to the right-leg-lever axle;

a reel end of the right-leg cable attached to the right-leg cable reel;

a right-side cable crank having a right-side-crank axle parallel to the right-leg-reel axle and attached pivotally to the machine frame;

a right-leg-crank pulley wheel attached pivotally to a crank end of the right-side cable crank;

the right-leg cable being in selective contact with the right-leg-crank pulley wheel during portions of rotation of the right-side cable crank as determined by a portion of the right-leg cable reeled onto the right-leg-cable reel; and a rotational motor having a rotational gear in rotation-imparting relationship to the left-side-crank axle and to the right-side-crank axle selectively.

2. A physical-therapy machine according to claim 1 and further comprising:

an upper-left-arm support member pivotally attachable to a head end of a left side of the machine frame at a left-arm joint;

a lower-left-arm support member pivotally attachable to the upper-left-arm support member at a left-elbow joint;

an upper-right-arm support member pivotally attachable to a head end of a right side of the machine frame at a right-arm joint;

a lower-right-arm support member pivotally attachable to the upper-right-arm support member at a right-elbow joint;

a left-arm lever having a rod end of the left-arm lever pivotally attachable to the machine frame proximate the left-arm joint and a cable end of the left-arm lever extended into a head end of the machine frame;

a left-arm connecting rod having an arm end of the left-arm connecting rod pivotally attachable to a bottom side of the lower-left-arm support member and a lever end of the left-arm connecting rod pivotally attachable to the left-arm lever at a rod-attachment position between the arm end and the cable end of the left-arm lever;

a left-arm-crank pulley wheel pivotally attached to the crank end of the left-side cable crank concentrically with the left-leg-crank pulley wheel;

a left-arm-cable reel attached pivotally to a left-arm-reel axle which is attached to the machine frame and extended parallel to the axle of the left-side cable crank;

a left-arm cable having a lever end of the left-arm cable attached to the lever end of the left-arm lever and a reel end of the left-arm cable attached to the left-arm cable reel with the left-arm cable being in selective contact with the left-arm-crank pulley wheel during portions of rotation of the left-side cable crank as determined by a portion of the left-arm cable reeled onto the left-arm-cable reel;

a right-arm lever having a rod end of the right-arm lever pivotally attachable to the machine frame proximate the right-arm joint and a cable end of the right-arm lever extended into the head end of the machine frame;

a right-arm connecting rod having an arm end of the right-arm connecting rod pivotally attachable to a bottom side of the lower-right-arm support member and a lever end of the right-arm connecting rod pivotally attachable to the right-arm lever at a rod-attachment position between the arm end and the cable end of the right-arm lever;

a right-arm-crank pulley wheel pivotally attached to the crank end of the right-side cable crank concentrically with the right-leg-crank pulley wheel;

a right-arm-cable reel attached pivotally to a right-arm-reel axle which is attached to the machine frame and extended parallel to the axle of the right-side cable crank; and a right-arm cable having a lever end of the right-arm cable attached to the lever end of the right-arm lever and a reel end of the right-arm cable attached to the right-arm cable reel with the right-arm cable being in selective contact with the right-arm-crank pulley wheel during portions of rotation of the right-side cable crank as determined by a portion of the right-arm cable reeled onto the right-arm-cable reel.

3. A physical-therapy machine according to claim 2 and further comprising:

a head-support member pivotally attachable to a head of the machine platform at a head joint;

a head lever having a rod end of the head lever and a cable end of the head lever;

a head-lever axle with which the head lever is attached pivotally to the machine frame at a fulcrum position selectively between the rod end of the head lever and the cable end of the head lever;

a head connecting rod having a head end of the head connecting rod pivotally attached to a bottom side of the head-support member and having a lever end of the head connecting rod pivotally attached to the rod end of the head lever;

a head-crank pulley wheel pivotally attached to the crank end of a cable crank concentrically with a crank-pulley-wheel axle;

a head-cable reel attached pivotally to a head-reel axle which is attached to the machine frame and extended parallel to the axle of the cable crank; and a head cable having a lever end of the head cable attached to the cable end of the head lever and a reel end of the head cable attached to the head-cable reel with the head cable being in selective contact with the crank pulley wheel during portions of rotation of the cable crank as determined by a portion of the head cable reeled onto the head-cable reel.

4. A physical-therapy machine according to claim 3 wherein the cable crank is positioned selectively between the head end and the foot end of the machine frame and the left-side cable crank and the right-side cable crank are oppositely disposed from each other at opposite ends of the cable crank.

5. A physical-therapy machine according to claim 4 wherein the head-cable reel, the left-arm-cable reel, the right-arm-cable reel, the left-leg-cable reel and the right-leg-cable reel are positioned vertically below the cable crank.

6. A physical-therapy machine according to claim 5 wherein the left-leg cable and the right-leg cable are positioned at a head side of the cable crank and the left-arm cable, the right-arm cable and the head cable are positioned at a foot side of the cable crank.

7. A physical-therapy machine according to claim 6 and further comprising:

a right-side wall on the machine frame to which the head-reel axle, the right-leg-reel axle and the right-arm-reel axle are attached pivotally;

an arcuate orifice in the right-side wall through which the rod end of the right-arm lever is extended into the machine frame;

a left-side wall on the machine frame to which the left-leg-reel axle and the left-arm-reel axle are attached; and an arcuate orifice in the left-side wall through which the rod end of the left-arm lever is extended into the machine frame.

8. A physical-therapy machine according to claim 1 and further comprising:

a reel-rotation anchor means with which the left-leg reel and the right-leg reel are rotatable to and maintained in a desired rotational position such that select lengths of the left-leg cable and the right-leg cable can be positioned in contact with the left-leg pulley wheel and the right-leg pulley wheel respectively during select portions of rotation of the cable crank.

9. A physical-therapy machine according to claim 7 and further comprising:

a separate plurality of reel-anchor orifices in reel-anchor material attached to the machine frame circumferentially around an outside periphery of a reel bearing in which the left-leg-reel axle, the right-leg-reel axle, the left-arm-reel axle, the right-arm-reel axle and the head-reel axle respectively are pivotal;

a separate reel-rotation rod in linearly-slidable engagement with the left-leg-reel axle, the right-leg-reel axle, the left-arm-reel axle, the right-arm-reel axle and the head-reel axle respectively;

at least one rod-spline surface on each separate reel-rotation rod in rotation-resistance relationship to at least one axle-spline surface on the left-leg-reel axle, the right-leg-reel axle, the left-arm-reel axle, the right-arm-reel axle and the head-reel axle respectively;

a rotational-handle extension on each reel-rotation rod;

an anchor pin attached to each rotational-handle extension at a position in which the anchor pin is insertional into a reel-anchor orifice in the separate plurality of reel-anchor orifices circumferentially around an outside periphery of the reel bearing in which the left-leg-reel axle, the right-leg-reel axle, the left-arm-reel axle, the right-arm-reel axle and the head-reel axle respectively are pivotal; and a separate anchor spring in inwardly-pressured linear relationship between the reel-rotation rod and the left-leg-reel axle, the right-leg-reel axle, the left-arm-reel axle, the right-arm-reel axle and the head-reel axle respectively.

10. A physical-therapy machine according to claim 9 wherein the reel-rotation rod is slidable into a matching orifice in each respective reel axle, the rotational-handle extension is a knob on an exterior end of the reel-rotation rod, the anchor pin is extended inwardly from an inside surface of the knob and further comprising:

a spring orifice extended between the reel-anchor orifice and an inside surface of each respective reel in each respective reel axle;

rod spring-attachment means on each respective reel-rotation rod; and reel spring-attachment means on the inside surface of each respective reel such that an anchor spring attached to each respective reel-rotation rod and to the inside surface of each respective reel causes insertion of the anchor pin in an anchor-pin orifice when the knob is not being pulled outwardly for rotation to adjust rotational setting of the respective reels.

11. A physical-therapy machine according to claim 6 and further comprising:

a reel-rotation anchor means with which the left-leg reel, the right-leg reel, the left-arm reel, the right-arm reel, and the head reel are rotatable to and maintained in a desired rotational position such that select lengths of the left-leg cable, the right-leg cable, the left-arm cable, the right-arm cable and the head cable can be positioned in contact with the left-leg pulley wheel, the right-leg pulley wheel, the left-arm pulley wheel, the right-arm pulley wheel and the head pulley wheel respectively during select portions of rotation of the cable crank.

12. A physical-therapy machine according to claim 1 and further comprising:

a separate rotation restraint on the left-leg joint and on the right-leg joint in rotation-restraining relationship between the upper-leg-support member and the lower-leg-support member of the left-leg-support member and the right-leg-support member respectively.

13. A physical-therapy machine according to claim 12 wherein the separate rotation restraints are comprised of:

splines in serrated relationship on an external periphery of an external end of a left-leg-joint axle and on an external periphery of an external end of a right-leg-joint axle;

a separate restraint sleeve having matching splines in serrated relationship on an internal periphery of the separate restraint sleeve which matching splines in serrated relationship are fittable onto the splines in serrated relationship on the external periphery of the external end of the left-leg-joint axle and fittable onto the splines in serrated relationship on the external periphery of the external end of the right-leg-joint axle respectively;

a restraint wall protruding radially from each separate restraint sleeve and extended linearly from each separate restraint sleeve to a position radially external from the left-leg joint and the right-leg joint respectively such that the left-leg-upper-support member and the right-leg-upper-support member respectively are caused to buttress against the restraint wall when being rotated upwardly and thereby are restrained in rotational travel selectively in accordance with circumferential positioning of the separate restraint sleeve onto the splines in serrated relationship on the external periphery of the external end of the left-leg-joint axle and onto the splines in serrated relationship on the external periphery of the external end of the right-leg-joint axle respectively;

splines in serrated relationship on an external periphery of an external end of a left-knee-joint axle and on an external periphery of an external end of a right-knee-joint axle;

a separate restraint sleeve having matching splines in serrated relationship on an internal periphery of the separate restraint sleeve which matching splines in serrated relationship are fittable onto the splines in serrated relationship on the external periphery of the external end of the left-knee-joint axle and fittable onto the splines in serrated relationship on the external periphery of the external end of the right-knee-joint axle respectively; and a restraint wall protruding radially from each separate restraint sleeve and extended linearly from each separate restraint sleeve to a position radially external from the left-knee joint and the right-knee joint respectively such that the left-leg-lower-support member and the right-leg-lower-support member respectively are caused to buttress against the restraint wall when being rotated upwardly and thereby are restrained in rotational travel selectively in accordance with circumferential positioning of the separate restraint sleeve onto the splines in serrated relationship on the external periphery of the external end of the left-knee-joint axle and onto the splines in serrated relationship on the external periphery of the external end of the right-knee-joint axle respectively.

14. A physical-therapy machine according to claim 6 and further comprising:

a separate rotation restraint on the left-leg joint and on the right-leg joint in rotation-restraining relationship between the upper-leg-support member and the lower-leg-support member of the left-leg-support member and the right-leg-support member respectively.

15. A physical-therapy machine according to claim 14 wherein the separate rotation restraints are comprised of:

splines in serrated relationship on an external periphery of an external end of a left-leg-joint axle and on an external periphery of an external end of a right-leg-joint axle;

a separate restraint sleeve having matching splines in serrated relationship on an internal periphery of the separate restraint sleeve which matching splines in serrated relationship are fittable onto the splines in serrated relationship on the external periphery of the external end of the left-leg-joint axle and fittable onto the splines in serrated relationship on the external periphery of the external end of the right-leg-joint axle respectively;

a restraint wall protruding radially from each separate restraint sleeve and extended linearly from each separate restraint sleeve to a position radially external from the left-leg joint and the right-leg joint respectively such that the left-leg-upper-support member and the right-leg-upper-support member respectively are caused to buttress against the restraint wall when being rotated upwardly and thereby are restrained in rotational travel selectively in accordance with circumferential positioning of the separate restraint sleeve onto the splines in serrated relationship on the external periphery of the external end of the left-leg-joint axle and onto the splines in serrated relationship on the external periphery of the external end of the right-leg-joint axle respectively;

splines in serrated relationship on an external periphery of an external end of a left-knee-joint axle and on an external periphery of an external end of a right-knee-joint axle;

a separate restraint sleeve having matching splines in serrated relationship on an internal periphery of the separate restraint sleeve which matching splines in serrated relationship are fittable onto the splines in serrated relationship on the external periphery of the external end of the left-knee-joint axle and fittable onto the splines in serrated relationship on the external periphery of the external end of the right-knee-joint axle respectively; and a restraint wall protruding radially from each separate restraint sleeve and extended linearly from each separate restraint sleeve to a position radially external from the left-knee joint and the right-knee joint respectively such that the left-leg-lower-support member and the right-leg-lower-support member respectively are caused to buttress against the restraint wall when being rotated upwardly and thereby are restrained in rotational travel selectively in accordance with circumferential positioning of the separate restraint sleeve onto the splines in serrated relationship on the external periphery of the external end of the left-knee-joint axle and onto the splines in serrated relationship on the external periphery of the external end of the right-knee-joint axle respectively.

16. A physical-therapy machine according to claim 15 and further comprising:

a separate rotation restraint on the left-arm joint and on the right-arm joint in rotation-restraining relationship between the upper-arm-support member and the lower-arm-support member of the left-arm-support member and the right-arm-support member respectively.

17. A physical-therapy machine according to claim 16 wherein the separate rotation restraints are comprised of:

splines in serrated relationship on an external periphery of an external end of a left-arm-joint axle and on an external periphery of an external end of a right-arm-joint axle;

a separate restraint sleeve having matching splines in serrated relationship on an internal periphery of the separate restraint sleeve which matching splines in serrated relationship are fittable onto the splines in serrated relationship on the external periphery of the external end of the left-arm-joint axle and fittable onto the splines in serrated relationship on the external periphery of the external end of the right-arm-joint axle respectively.

a restraint wall protruding radially from each separate restraint sleeve and extended linearly from each separate restraint sleeve to a position radially external from the left-arm joint and the right-arm joint respectively such that the left-arm-upper-support member and the right-arm-upper-support member respectively are caused to buttress against the restraint wall when being rotated upwardly and thereby are restrained in rotational travel selectively in accordance with circumferential positioning of the separate restraint sleeve onto the splines in serrated relationship on the external periphery of the external end of the left-arm-joint axle and onto the splines in serrated relationship on the external periphery of the external end of the right-arm-joint axle respectively;

splines in serrated relationship on an external periphery of an external end of a left-elbow-joint axle and on an external periphery of an external end of a right-elbow-joint axle;

a separate restraint sleeve having matching splines in serrated relationship on an internal periphery of the separate restraint sleeve which matching splines in serrated relationship are fittable onto the splines in serrated relationship on the external periphery of the external end of the left-elbow-joint axle and fittable onto the splines in serrated relationship on the external periphery of the external end of the right-elbow-support member respectively; and a restraint wall protruding radially from each separate restraint sleeve and extended linearly from each separate restraint sleeve to a position radially external from the left-elboe joint and the right-elbow joint respectively such external from the left-elbow joint and the right-elbow joint respectively such that the left-arm-lower-support member and the right-arm-lower-support member respectively are caused to buttress against the restraint wall when being rotated upwardly and thereby are restrained in rotational travel selectively in accordance with circumferential positioning of the separate restraint sleeve onto the splines in serrated relationship on the external periphery of the external end of the left-elbow-joint axle and onto the splines in serrated relationship on the external periphery of the external end of the right-elbow-joint axle respectively.

18. A physical-therapy machine according to claim 17 and further comprising:

a rotation restraint on the head joint in rotation-restraining relationship between the head-support member and the machine frame.

19. A physical-therapy machine according to claim 18 wherein the rotation restraint is comprised of:

splines in serrated relationship on an external periphery of an external end of a head-joint axle;

a restraint sleeve having matching splines in serrated relationship on an internal periphery of the restraint sleeve which matching splines in serrated relationship are fittable onto the splines in serrated relationship on the external periphery of the external end of the head-joint axle;

a restraint wall protruding radially from the restraint sleeve and extended linearly from the restraint sleeve to a position radially external from the head joint such that the head-support member is caused to buttress against the restraint wall when being rotated upwardly and thereby to be restrained in rotational travel in accordance with circumferential positioning of the restraint sleeve onto the splines in serrated relationship on the external periphery of the external end of the head-joint axle.

20. A physical-therapy machine according to claim 10 and further comprising:

splines in serrated relationship on an external periphery of an external end of a left-leg-joint axle and on an external periphery of an external end of a right-leg-joint axle;

a separate restraint sleeve having matching splines in serrated relationship on an internal periphery of the separate restraint sleeve which matching splines in serrated relationship are fittable onto the splines in serrated relationship on the external periphery of the external end of the left-leg-joint axle and fittable onto the splines in serrated relationship on the external periphery of the external end of the right-leg-joint axle respectively;

a restraint wall protruding radially from each separate restraint sleeve and extended linearly from each separate restraint sleeve to a position radially external from the left-leg joint and the right-leg joint respectively such that the left-leg-upper-support member and the right-leg-upper-support member respectively are caused to buttress against the restraint wall when being rotated upwardly and thereby are restrained in rotational travel selectively in accordance with circumferential positioning of the separate restraint sleeve onto the splines in serrated relationship on the external periphery of the external end of the left-leg-joint axle and onto the splines in serrated relationship on the external periphery of the external end of the right-leg-joint axle respectively.

splines in serrated relationship on an external periphery of an external end of a left-knee-joint axle and on an external periphery of an external end of a right-knee-joint axle;

a separate restraint sleeve having matching splines in serrated relationship on an internal periphery of the separate restraint sleeve which matching splines in serrated relationship are fittable onto the splines in serrated relationship on the external periphery of the external end of the left-knee-joint axle and fittable onto the splines in serrated relationship on the external periphery of the external end of the right-knee-joint axle respectively;

a restraint wall protruding radially from each separate restraint sleeve and extended linearly from each separate restraint sleeve to a position radially external from the left-knee joint and the right-knee joint respectively such that the left-leg-lower-support member and the right-leg-lower-support member respectively are caused to buttress against the restraint wall when being rotated upwardly and thereby are restrained in rotational travel selectively in accordance with circumferential positioning of the separate restraint sleeve onto the splines in serrated relationship on the external periphery of the external end of the left-knee-joint axle and onto the splines in serrated relationship on the external periphery of the external end of the right-knee-joint axle respectively;

splines in serrated relationship on an external periphery of an external end of a left-arm-joint axle and on an external periphery of an external end of a right-arm-joint axle;

a separate restraint sleeve having matching splines in serrated relationship on an internal periphery of the separate restraint sleeve which matching splines in serrated relationship are fittable onto the splines in serrated relationship on the external periphery of the external end of the left-arm-joint axle and fittable onto the splines in serrated relationship on the external periphery of the external end of the right-arm-joint axle respectively;

a restraint wall protruding radially from each separate restraint sleeve and extended linearly from each separate restraint sleeve to a position radially external from the left-arm joint and the right-arm joint respectively such that the left-arm-upper support member and the right-arm-upper-support member respectively are caused to buttress against the restraint wall when being rotated upwardly and thereby are restrained in rotational travel selectively in accordance with circumferential positioning of the separate restraint sleeve onto the splines in serrated relationship on the external periphery of the external end of the left-arm-joint axle and onto the splines in serrated relationship on the external periphery of the external end of the right-arm-joint axle respectively;

splines in serrated relationship on an external periphery of an external end of a left-elbow-joint axle and on an external periphery of an external end of a right-elbow-joint axle;

a separate restraint sleeve having matching splines in serrated relationship on an internal periphery of the separate restraint sleeve which matching splines in serrated relationship are fittable onto the splines in serrated relationship on the external periphery of the external end of the left-elbow-joint axle and fittable onto the splines in serrated relationship on the external periphery of the external end of the right-elbow-support member respectively.

a restraint wall protruding radially from each separate restraint sleeve and extended linearly from each separate restraint sleeve to a position radially external from the left-elbow joint and the right-elbow joint respectively such that the left-arm-lower-support member and the right-arm-lower-support member respectively are caused to buttress against the restraint wall when being rotated upwardly and thereby are restrained in rotational travel selectively in accordance with circumferential positioning of the separate restraint sleeve onto the splines in serrated relationship on the external periphery of the external end of the left-elbow-joint axle and onto the splines in serrated relationship on the external periphery of the external end of the right-elbow-joint axle respectively;

splines in serrated relationship on an external periphery of an external end of a head-joint axle;

a restraint sleeve having matching splines in serrated relationship on an internal periphery of the restraint sleeve which matching splines in serrated relationship are fittable onto the splines in serrated relationship on the external periphery of the external end of the head-joint axle; and a restraint wall protruding radially from the restraint sleeve and extended linearly from the restraint sleeve to a position radially external from the head joint such that the head-support member is caused to buttress against the restraint wall when being rotated upwardly and thereby to be restrained in rotational travel in accordance with circumferential positioning of the restraint sleeve onto the splines in serrated relationship on the external periphery of the external end of the head-joint axle.

21. A physical-therapy machine according to claim 20 and further comprising:

a control panel having an operational timer and an operational-speed controller in operational-control relationship with the rotational motor such that time and speed operation of this physical-therapy machine can be controlled as desired.

22. A physical-therapy machine according to claim 1 and further comprising:

a control panel having an operational timer and an operational-speed controller in operational-control relationship with the rotational motor such that time and speed operation of this physical-therapy machine can be controlled as desired.

23. A physical-therapy machine according to claim 21 and further comprising:

a leg-tie-down strap on the lower left-leg-support member;

a leg-tie-down strap on the lower right-leg-support member;

an arm-tie-down strap on the lower left-arm-support member;

an arm-tie-down strap on the lower right-arm-support member; and a head-tie-down strap on the head-support member such that muscle resistance to movement can be applied for exercise of muscles as desired in combination with actuation of joints for joint exercise with this physical-therapy machine.

24. A physical-therapy machine according to claim 1 and further comprising:

a leg-tie-down strap on the lower left-leg-support member; and a leg-tie-down strap on the lower right-leg-support member such that muscle resistance to movement can be applied for exercise of muscles as desired in combination with actuation of joints for joint exercise with this physical-therapy machine.

25. A physical-therapy machine comprising:

a body platform on a top of a machine frame;

an upper-left-leg support member pivotally attachable to a foot end of the machine frame at a left-leg joint;

a lower-left-leg support member pivotally attachable to the upper-left-leg support member at a left-knee joint;

an upper-right-leg support member pivotally attachable to a foot end of the machine frame at a right-leg joint;

a lower-right-leg support member pivotally attachable to the upper-right-leg support member at a right-knee joint;

a left-leg connecting rod pivotally attachable to a bottom side of the lower-left-leg support member and extended into a foot end of the machine frame;

a left-leg lever to which the left-leg connecting rod is pivotally attached at a rod end of the left-leg lever;

a left-leg cable having a lever end of the left-leg cable attached to a cable end of the left-leg lever;

a left-leg-lever axle to which the left-leg lever is attached pivotally at a fulcrum position between the rod end of the left-leg lever and the cable end of the left-leg lever;

the left-leg-lever axle being attached to the machine frame and extended perpendicularly to the upper-left-leg support member and the lower-left-leg support member within the machine frame;

a left-leg-cable reel attached pivotally to a left-leg-reel axle attached to the machine frame and extended parallel to the left-leg-lever axle;

a reel end of the left-leg cable attached to the left-leg cable reel;

a left-side cable crank having a left-side crank axle parallel to the left-leg-reel axle and attached pivotally to the machine frame;

a left-leg-crank pulley wheel attached pivotally to a crank end of the left-side cable crank;

the left-leg cable being in selective contact with the left-leg-crank pulley wheel during portions of rotation of the left-side cable crank as determined by a portion of the left-leg cable reeled onto the left-leg-cable reel;

a right-leg connecting rod pivotally attachable to a bottom side of the lower-right-leg support member and extended into the foot end of the machine frame;

a right-leg lever to which the right-leg connecting rod is pivotally attached at a rod end of the right-leg lever;

a right-leg cable having a lever end of the right-leg cable attached to a cable end of the right-leg lever;

a right-leg-lever axle to which the right-leg lever is attached pivotally at a fulcrum position between the rod end of the right-leg lever and the cable end of the right-leg lever;

the right-leg-lever axle being attached to the machine frame and extended perpendicularly to the upper-right-leg support member and the lower-right-leg support member within the machine frame;

a right-leg cable reel attached pivotally to a right-leg-reel axle attached to the machine frame and extended parallel to the right-leg-lever axle;

a reel end of the right-leg cable attached to the right-leg cable reel;

a right-side cable crank having a right-side-crank axle parallel to the right-leg-reel axle and attached pivotally to the machine frame;

a right-leg-crank pulley wheel attached pivotally to a crank end of the right-side cable crank;

the right-leg cable being in selective contact with the right-leg-crank pulley wheel during portions of rotation of the right-side cable crank as determined by a portion of the right-leg cable reeled onto the right-leg-cable reel;

a rotational motor having a rotational gear in rotation-imparting relationship to the left-side-crank axle and to the right-side-crank axle selectively;

an upper-left-arm support member pivotally attachable to a head end of a left side of the machine frame at a left-arm joint;

a lower-left-arm support member pivotally attachable to the upper-left-arm support member at a left-elbow joint;

an upper-right-arm support member pivotally attachable to a head end of a right side of the machine frame at a right-arm joint;

a lower-right-arm support member pivotally attachable to the upper-right-arm support member at a right-elbow joint;

a left-arm lever having a rod end of the left-arm lever pivotally attachable to the machine frame proximate the left-arm joint and a cable end of the left-arm lever extended into a head end of the machine frame;

a left-arm connecting rod having an arm end of the left-arm connecting rod pivotally attachable to a bottom side of the lower-left-arm support member and a lever end of the left-arm connecting rod pivotally attachable to the left-arm lever at a rod-attachment position between the arm end and the cable end of the left-arm lever;

a left-arm-crank pulley wheel pivotally attached to the crank end of the left-side cable crank concentrically with the left-leg-crank pulley wheel;

a left-arm-cable reel attached pivotally to a left-arm-reel axle which is attached to the machine frame and extended parallel to the axle of the left-side cable crank;

a left-arm cable having a lever end of the left-arm cable attached to the lever end of the left-arm lever and a reel end of the left-arm cable attached to the left-arm cable reel with the left-arm cable being in selective contact with the left-arm-crank pulley wheel during portions of rotation of the left-side cable crank as determined by a portion of the left-arm cable reeled onto the left-arm-cable reel;

a right-arm lever having a rod end of the right-arm lever pivotally attachable to the machine frame proximate the right-arm joint and a cable end of the right-arm lever extended into the head end of the machine frame;

a right-arm connecting rod having an arm end of the right-arm connecting rod pivotally attachable to a bottom side of the lower-right-arm support member and a lever end of the right-arm connecting rod pivotally attachable to the right-arm lever at a rod-attachment position between the arm end and the cable end of the right-arm lever;

a right-arm-crank pulley wheel pivotally attached to the crank end of the right-side cable crank concentrically with the right-leg-crank pulley wheel;

a right-arm-cable reel attached pivotally to a right-arm-reel axle which is attached to the machine frame and extended parallel to the axle of the right-side cable crank;

a right-arm cable having a lever end of the right-arm cable attached to the lever end of the right-arm lever and a reel end of the right-arm cable attached to the right-arm cable reel with the right-arm cable being in selective contact with the right-arm-crank pulley wheel during portions of rotation of the right-side cable crank as determined by a portion of the right-arm cable reeled onto the right-arm-cable reel;

a head-support member pivotally attachable to a head of the machine platform at a head joint;

a head lever having a rod end of the head lever and a cable end of the head lever;

a head-lever axle with which the head lever is attached pivotally to the machine frame at a fulcrum position selectively between the rod end of the head lever and the cable end of the head lever;

a head connecting rod having a head end of the head connecting rod pivotally attached to a bottom side of the head-support member and having a lever end of the head connecting rod pivotally attached to the rod end of the head lever;

a head-crank pulley wheel pivotally attached to the crank end of a cable crank concentrically with a crank-pulley-wheel axle;

a head-cable reel attached pivotally to a head-reel axle which is attached to the machine frame and extended parallel to the axle of the cable crank;

a head cable having a lever end of the head cable attached to the cable end of the head lever and a reel end of the head cable attached to the head-cable reel with the head cable being in selective contact with the crank pulley wheel during portions of rotation of the cable crank as determined by a portion of the head cable reeled onto the head-cable reel;

the cable crank is positioned selectively between the head end and the foot end of the machine frame and the left-side cable crank and the right-side cable crank are oppositely disposed from each other at opposite ends of the cable crank;

the head-cable reel, the left-arm-cable reel, the right-arm-cable reel, the left-leg-cable reel and the right-leg-cable reel are positioned vertically below the cable crank;

the left-leg cable and the right-leg cable are positioned at a head side of the cable crank and the left-arm cable, the right-arm cable and the head cable are positioned at a foot side of the cable crank;

a right-side wall on the machine frame to which the head-reel axle, the right-leg-reel axle and the right-arm-reel axle are attached pivotally;

an arcuate orifice in the right-side wall through which the rod end of the right-arm lever is extended into the machine frame;

a left-side wall on the machine frame to which the left-leg-reel axle and the left-arm-reel axle are attached;

an arcuate orifice in the left-side wall through which the rod end of the left-arm lever is extended into the machine frame;

a reel-rotation anchor means with which the left-leg reel, the right-leg reel, the left-arm reel, the right-arm reel and the head reel are rotatable to and maintained in a desired rotational position such that select lengths of the left-leg cable, the right-leg cable, the left-arm cable, the right-arm cable and the head cable can be positioned in contact with the left-leg pulley wheel, the right-leg pulley wheel, the left-arm pulley wheel, the right-arm pulley wheel and the head pulley wheel respectively during select portions of rotation of the cable crank;

a separate rotation restraint on the left-leg joint and on the right-leg joint in rotation-restraining relationship between the upper-leg-support member and the lower-leg-support member of the left-leg-support member and the right-leg-support member respectively, a separate rotation restraint on the left-arm joint and on the right-arm joint in rotation-restraining relationship between the upper-arm-support member and the lower-arm-support member of the left-arm-support member and the right-arm-support member respectively; and a rotation restraint on the head joint in rotation-restraining relationship between the head-support member and the machine frame.

26. A physical-therapy machine according to claim 25 and further comprising:

a separate plurality of reel-anchor orifices in reel-anchor material attached to the machine frame circumferentially around an outside periphery of a reel bearing in which the left-leg-reel axle, the right-leg-reel axle, the left-arm-reel axle, the right-arm-reel axle and the head-reel axle respectively are pivotal;

a separate reel-rotation rod in linearly-slidable engagement with the left-leg-reel axle, the right-leg-reel axle, the left-arm-reel axle, the right-arm-reel axle and the head-reel axle respectively;

at least one rod-spline surface on each separate reel-rotation rod in rotation-resistance relationship to at least one axle-spline surface on the left-leg-reel axle, the right-leg-reel axle, the left-arm-reel axle, the right-arm-reel axle and the head-reel axle respectively;

a rotational-handle extension on each reel-rotation rod;

an anchor pin attached to each rotational-handle extension at a position in which the anchor pin is insertional into a reel-anchor orifice in the separate plurality of reel-anchor orifices circumferentially around an outside periphery of the reel bearing in which the left-leg-reel axle, the right-leg-reel axle, the left-arm-reel axle, the right-arm-reel axle and the head-reel axle respectively are pivotal;

a separate anchor spring in inwardly-pressured linear relationship between the reel-rotation rod and the left-leg-reel axle, the right-leg-reel axle, the left-arm-reel axle, the right-arm-reel axle and the head-reel axle respectively;

the reel-rotation rod is slidable into a matching orifice in each respective reel axle, the rotational-handle extension is a knob on an exterior end of the reel-rotation rod, the anchor pin is extended inwardly from an inside surface of the knob and further comprising:

a spring orifice extended between the reel-anchor orifice and an inside surface of each respective reel in each respective reel axle;

rod spring-attachment means on each respective reel rotation rod; and reel spring-attachment means on the inside surface of each respective reel such that an anchor spring attached to each respective reel-rotation rod and to the inside surface of each respective reel causes insertion of the anchor pin in an anchor-pin orifice when the knob is not being pulled downwardly for rotation to adjust rotational setting of the respective reels.

27. A physical-therapy machine according to claim 26 and further comprising:

splines in serrated relationship on an external periphery of an external end of a left-leg-joint axle and on an external periphery of an external end of a right-leg-joint axle;

a separate restraint sleeve having matching splines in serrated relationship on an internal periphery of the separate restraint sleeve which matching splines in serrated relationship are fittable onto the splines in serrated relationship on the external periphery of the external end of the left-leg-joint axle and fittable onto the splines in serrated relationship on the external periphery of the external end of the right-leg-joint axle respectively;

a restraint wall protruding radially from each separate restraint sleeve and extended linearly from each separate restraint sleeve to a position radially external from the left-leg joint and the right-leg joint respectively such that the left-leg-upper-support respectively are caused to buttress against the restraint wall when being rotated upwardly and thereby are restrained in rotational travel selectively in accordance with circumferential positioning of the separate restraint sleeve onto the splines in serrated relationship on the external periphery of the external end of the left-leg-joint axle and onto the splines in serrated relationship on the external periphery of the external end of the right-leg-joint axle respectively;

splines in serrated relationship on an external periphery of an external end of a left-knee-joint axle and on an external periphery of an external end of a right-knee-joint axle;

a separate restraint sleeve having matching splines in serrated relationship on an internal periphery of the separate restraint sleeve which matching splines in serrated relationship are fittable onto the splines in serrated relationship on the external periphery of the external end of the left-knee-joint axle and fittable onto the splines in serrated relationship on the external periphery of the external end of the right-knee-joint axle respectively;

a restraint wall protruding radially from each separate restraint sleeve and extended linearly from each separate restraint sleeve to a position radially external from the left-knee joint and the right-knee joint respectively such that the left-leg-lower-support member and the right-leg-lower-support member respectively are caused to buttress against the restraint wall when being rotated upwardly and thereby are restrained in rotational travel selectively in accordance with circumferential positioning of the separate restraint sleeve onto the splines in serrated relationship on the external periphery of the external end of the left-knee-joint axle and onto the splines in serrated relationship on the external periphery of the external end of the right-knee-joint axle respectively;

splines in serrated relationship on an external periphery of an external end of a left-arm-joint axle and on an external periphery of an external end of a right-arm-joint axle;

a separate restraint sleeve having matching splines in serrated relationship on an internal periphery of the separate restraint sleeve which matching splines in serrated relationship are fittable onto the splines in serrated relationship on the external periphery of the external end of the left-arm-joint axle and fittable onto the splines in serrated relationship on the external periphery of the external end of the right-arm-joint axle respectively;

a restraint wall protruding radially from each separate restraint sleeve and extended linearly from each separate restraint sleeve to a position radially external from the left-arm joint and the right-arm joint respectively such that the left-arm-upper-support member and the right-arm-upper-support member respectively are caused to buttress against the restraint wall when being rotated upwardly and thereby are restrained in rotational travel selectively in accordance with circumferential positioning of the separate restraint sleeve onto the splines in serrated relationship on the external periphery of the external end of the left-arm-joint axle and onto the splines in serrated relationship on the external periphery of the external end of the right-arm-joint axle respectively;

splines in serrated relationship on an external periphery of an external end of a left-elbow-joint axle and on an external periphery of an external end of a right-elbow-joint axle;

a separate restraint sleeve having matching splines in serrated relationship on an internal periphery of the separate restraint sleeve which matching splines in serrated relationship are fittable onto the splines in serrated relationship on the external periphery of the external end of the left-elbow-joint axle and fittable onto the splines in serrated relationship on the external periphery of the external end of the right-elbow-support member respectively;

a restraint wall protruding radially from each separate restraint sleeve and extended linearly from each separate restraint sleeve to a position radially external from the left-elbow joint and the right-elbow joint respectively such that the left-arm-lower-support member and the right-arm-lower-support member respectively are caused to buttress against the restraint wall when being rotated upwardly and thereby are restrained in rotational travel selectively in accordance with circumferential positioning of the separate restraint sleeve onto the splines in serrated relationship on the external periphery of the external end of the left-elbow-joint axle and onto the splines in serrated relationship on the external periphery of the external end of the right-elbow-joint axle respectively;

splines in serrated relationship on an external periphery of an external end of a head-joint axle;

a restraint sleeve having matching splines in serrated relationship on an internal periphery of the restraint sleeve which matching splines in serrated relationship are fittable onto the splines in serrated relationship on the external periphery of the external end of the head-joint axle; and a restraint wall protruding radially from the restraint sleeve and extended linearly from the restraint sleeve to a position radially external from the head joint such that the head-support member is caused to buttress against the restraint wall when being rotated upwardly and thereby to be restrained in rotational travel in accordance with circumferential positioning of the restraint sleeve onto the splines in serrated relationship on the external periphery of the external end of the head-joint axle.

28. A physical-therapy machine according to claim 27 and further comprising:

a leg-tie-down strap on the lower left-leg-support member;

a leg-tie-down strap on the lower right-leg-support member;

an arm-tie-down strap on the lower left-arm-support member;

an arm-tie-down strap on the lower right-arm-support member; and a head-tie-down strap on the head-support member such that muscle resistance to movement can be applied for exercise of muscles as desired in combination with actuation of joints for joint exercise with this physical-therapy machine.

* * * * *

UNITED STATES PATENT AND TRADEMARK OFFICE

CERTIFICATE OF CORRECTION

PATENT NO. : 5,207,216

DATED : 05/04/93

INVENTOR(S) : David R. Sweeney

It is certified that error appears in the above-identified patent and that said Letters Patent is hereby corrected as shown below:

On the title page, item [75] Inventor:

In the heading, the inventor's name should be changed to its correct spelling as --Sweeney-- and likewise after the caption "Inventor:" to read --David R. Sweeney--.

Signed and Sealed this

Fifth Day of April, 1994

Bruce Lehman

BRUCE LEHMAN

*Commissioner of Patents and Trademarks*

*Attest:*

*Attesting Officer*